US009164492B2

(12) United States Patent
Philippine et al.

(10) Patent No.: US 9,164,492 B2
(45) Date of Patent: Oct. 20, 2015

(54) ZERO-RESET DEVICE WITH INDEPENDENT HAMMERS

(71) Applicant: Société anonyme de la Manufacture d'horlogerie Audemars Piguet & Cie, Le Brassus (CH)

(72) Inventors: Thibaut Philippine, Vallorbe (CH); Jacques Gabathuler, Chêne-Bougeries (CH); Johan Montet, Les Charbonnières (CH)

(73) Assignee: Société anonyme de la Manufacture d'horlogerie Audemars Piguet & Cie, Le Brassus (CH)

( * ) Notice: Subject to any disclaimer, the term of this patent is extended or adjusted under 35 U.S.C. 154(b) by 0 days.

(21) Appl. No.: 14/567,116

(22) Filed: Dec. 11, 2014

(65) Prior Publication Data

US 2015/0168919 A1 Jun. 18, 2015

(30) Foreign Application Priority Data

Dec. 16, 2013 (CH) ..... 2080/13

(51) Int. Cl.
*G04F 7/06* (2006.01)
*G04F 7/08* (2006.01)

(52) U.S. Cl.
CPC ..... *G04F 7/0809* (2013.01); *G04F 7/062* (2013.01); *G04F 7/0814* (2013.01)

(58) Field of Classification Search
CPC ..... G04F 7/00; G04F 7/062; G04F 7/0814; G04F 7/06
USPC ..... 368/101–106
See application file for complete search history.

(56) References Cited

U.S. PATENT DOCUMENTS

| | | | | |
|---|---|---|---|---|
| 5,793,708 | A * | 8/1998 | Schmidt et al. | 368/106 |
| 7,331,706 | B2 * | 2/2008 | Gabathuler et al. | 368/106 |
| 7,422,364 | B2 | 9/2008 | Scheufele | |
| 7,614,783 | B2 * | 11/2009 | Golay | 368/106 |
| 7,871,197 | B2 * | 1/2011 | Wyssbrod | 368/106 |

(Continued)

FOREIGN PATENT DOCUMENTS

| | | | |
|---|---|---|---|
| CH | 146042 | A | 3/1931 |
| CH | 623 980 | A3 | 7/1981 |

(Continued)

*Primary Examiner* — Sean Kayes
(74) *Attorney, Agent, or Firm* — Christensen Fonder P.A.

(57) ABSTRACT

A zero-rest device for a timepiece, including first and second control mechanisms, two zero-reset cams, and two corresponding zero-reset hammers configured to cooperate with the cams. The device also includes two hammer springs exerting a pre-stress force causing a hammer to pivot in the direction of its corresponding cam, a winding and release mechanism and a locking mechanism. The winding and release mechanism is configured to wind the hammer springs during a first phase of an actuation of the first control mechanism and to cooperate, during a second phase of this actuation, with the locking means, such that the locking means passes from a rest position in which the locking means holds the hammers to a release position in which the locking means releases the hammers, which come, in each case under the action of the corresponding hammer spring, into the positions thereof of cooperation with the corresponding cam.

15 Claims, 9 Drawing Sheets

(56) References Cited

U.S. PATENT DOCUMENTS

| | | | | |
|---|---|---|---|---|
| 8,213,268 | B2 * | 7/2012 | Kato et al. | 368/112 |
| 8,491,181 | B2 * | 7/2013 | Fujiwara et al. | 368/106 |
| 8,540,417 | B2 * | 9/2013 | Hasegawa | 368/106 |
| 2004/0218473 | A1 * | 11/2004 | Takahashi et al. | 368/37 |

FOREIGN PATENT DOCUMENTS

| | | | |
|---|---|---|---|
| EP | 2 241 945 | A2 | 10/2010 |
| EP | 1 890 205 | B1 | 11/2011 |
| JP | 48-23063 | U | 3/1973 |
| JP | 49-35348 | Y | 9/1974 |

* cited by examiner

ZERO-RESET DEVICE WITH INDEPENDENT HAMMERS

RELATED APPLICATION

The present application claims priority to Swiss Patent Application No. CH 02080/13 filed Dec. 16, 2013, the disclosure of which is hereby incorporated by reference herein in its entirety.

FIELD OF THE INVENTION

The present invention relates to a zero-reset device for a timepiece, in particular for a chronograph watch, the device comprising a first control means, a second control means connected kinematically to said first control means, at least two zero-reset cams, as well as at least two corresponding zero-reset hammers, which are pivoted independently of one another and can be actuated so as to cooperate with a corresponding zero-reset cam.

This invention more specifically relates to timepieces, in particular wristwatches, having a mechanical movement and being equipped with a chronograph mechanism or a fly-back hand. In this context, it is common for the second, minute and hour hands, possibly arranged as fly-back hands, to each be mounted on a shaft equipped with a heart-shaped cam which can cooperate with a corresponding hammer so as to return the hands to the rest positions thereof in the case of a zero reset or to a position defined by the reference hands in the case of a fly-back hand mechanism. In the conventional mechanisms, the hammers are often arranged on a one-piece part. This may pose problems due to the increase of force exerted by such a part, the necessary synchronization at the moment of striking against the individual hearts, the resulting accuracy of manufacture, the bulk of such a part, and also further disadvantages.

PRIOR ART

It has thus already been proposed in this context to use an arrangement of independent hammers. For example, patent application EP 2 241 945 proposes a chronograph mechanism having second hammers and minute hammers pivoted independently to one another and connected by a connection element. If the proposed arrangement has springs acting independently on the hammers, it is however necessary, amongst others due to said connection element, to provide a coaxial pivoting of the hammers as well as a minute counter jumper angularly pivoted concentrically with the minute counter wheel, which considerably limits the use of this device. Another design has been proposed in document EP 1 890 205. The corresponding device comprises a plurality of hammers that can be actuated by a control element in order to cooperate with a corresponding heart. The hammers pivot about respective independent pivots and are articulated to said control element, such that a movement in translation of said control element, due to the kinematic connection thereof to the hammers, directly causes a cooperation between the hammers and the corresponding hearts. However, such a direct kinematic connection is not optimal. In addition, this implies that the mechanism does not have springs tending to apply the hammers against the hearts and the potential lack of precision has to be compensated for, also by making the arms of the hammers resilient. It should therefore be noted that the solutions of the prior art currently known are not entirely satisfactory and/or cannot be used by all types of chronograph mechanism.

SUMMARY OF THE INVENTION

One object of the present invention is therefore to overcome, at least in part, the disadvantages of the known devices and to produce a zero-reset device equipped with independent hammers, which is provided with increased operational reliability, high accuracy in terms of the simultaneous actuation of the hammers, and also a well defined force applied to the heart-shaped cams. A further object of the present invention is also to produce this device by means of a robust construction that is as compact as possible and also simple and reliable during use. The device should be adapted for implementation just as well in a chronograph mechanism per se as in any other similar application, such as a fly-back hand mechanism.

To this end, the present invention proposes a zero-reset device of the above-mentioned type, which distinguishes by the features specified in claim 1. In particular, a device according to the present invention comprises at least two hammer springs, each of which is able to exert a pre-tension force causing a zero-reset hammer to pivot in the direction of the corresponding zero-reset cam, and a winding and release means as well as a locking means, said winding and release means being able to wind said hammer springs during a first phase of an actuation of the first control means and also to cooperate, during a second phase of the actuation of the first control means, with said locking means such that said locking means passes from a first, rest position, in which the locking means holds the zero-rest hammers in the rest positions thereof, to a second, release position, in which the locking means releases the zero-reset hammers, which come, in each case under the action of the corresponding hammer spring, into the positions thereof of cooperation with the corresponding zero-reset cam.

As a result of these measures, the zero reset is performed only if the manual force applied by the user of the timepiece to the first control means exceeds a predefined threshold value. In addition, the force applied by the hammers to the cams is always identical and equal to a predefined value. This is achieved whilst ensuring maximum independence of the hammers, which have no direct kinematic connection therebetween, at least not during application thereof to the cams.

These advantages can also be enhanced by arranging the winding and release means as well as the locking means advantageously, as is clear from the dependent claims. Likewise, the device comprises a return means of the zero-reset hammers able to return said hammers to the rest position thereof following actuation thereof, this return means being able to be arranged so as to maintain, in an optimal manner, the independence between the hammers. In addition, the zero-reset hammers of a device according to the present invention may advantageously all have the same geometry. All of these factors contribute to a particularly simple and reliable embodiment of such a device.

Further features as well as the corresponding advantages will become clear from the dependent claims and also from the description presenting the invention in greater detail hereinafter.

DESCRIPTION OF THE DRAWINGS

The accompanying drawings schematically show, by way of example, a number of embodiments of the invention.

DETAILED DESCRIPTION OF THE INVENTION

The invention will now be described in detail with reference to the accompanying drawings illustrating, by way of example, an embodiment of the invention.

The present invention relates to a zero-reset device intended for integration in a timepiece, preferably in a wristwatch having a mechanical movement. For reasons of simplification of the language used, reference will be made hereinafter synonymously to a "timepiece" and "watch", without hereby limiting the scope of the corresponding explanations, which in any case apply to any type of timepieces having either a mechanical or electrical energy source. In addition, such a timepiece normally comprises a chronograph mechanism or a fly-back hand mechanism, which is intended to be equipped with a zero-reset device according to the present invention. Given that the chronograph and fly-back hand mechanisms and also other similar mechanisms which are suitable for combination with the device according to the invention are known to a person skilled in the art, the following description will be limited to the structure and to the functioning of said device.

Figure 1A:
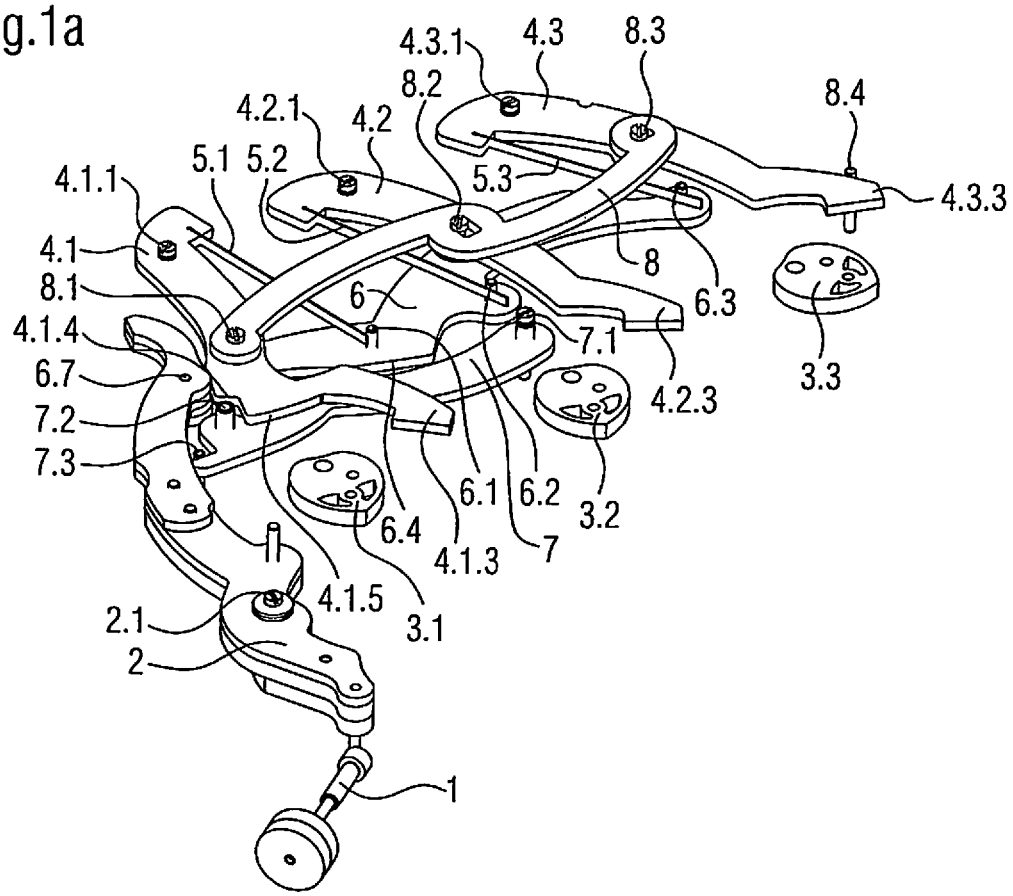
FIG. 1*a* shows a schematic perspective view of a first embodiment of the zero-reset device according to the present invention.
Figure 1B:
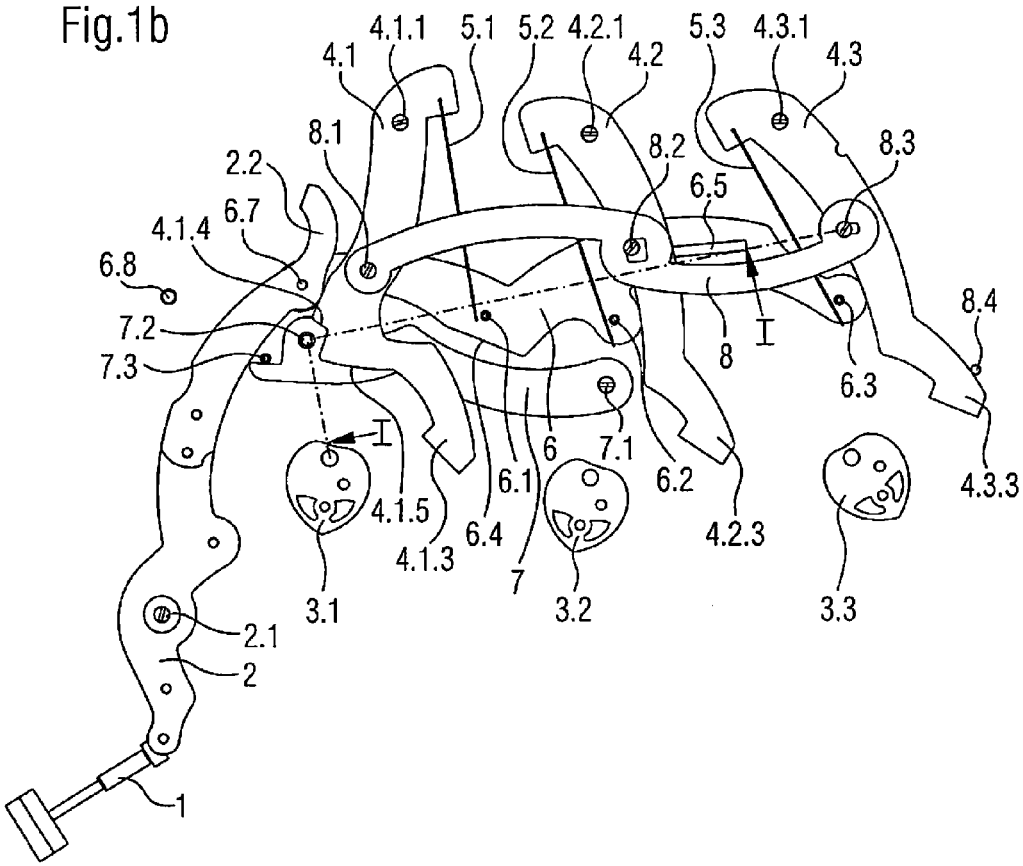
FIGS. 1*b* and 1*c* show, respectively, a plan view and a longitudinal section of this device along the line I-I indicated in FIG. 1*b*.
Figure 1C:
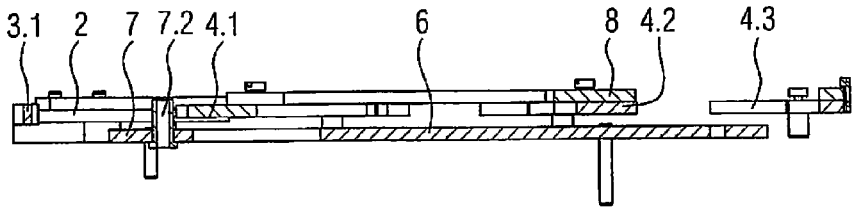

In order to comment first on the structure and on the components of a zero-reset device according to the present invention, reference is made to FIGS. 1*a* to 1*c*, which schematically illustrate by way of example a first embodiment of such a device by means of, respectively, a schematic perspective view, a plan view, and a longitudinal section of this device along the line I-I indicated in FIG. 1*b*. It can be seen that the device comprises, similarly to the devices of the prior art, a first control means or mechanism or controller 1, a second control means or mechanism or controller 2 connected kinematically to said first control means 1, at least two zero-reset cams 3.1, 3.2, 3.3, and at least two corresponding zero-reset hammers 4.1, 4.2, 4.3. The hammers 4.1, 4.2, 4.3 are pivoted independently of one another about pivot axes 4.1.1, 4.2.1, 4.3.1, normally positioned non-concentrically relative to one another, and are able to be actuated so as to cooperate with a corresponding zero-reset cam 3.1, 3.2, 3.3. To this end, said hammers each have an arm 4.1.3, 4.2.3, 4.3.3, of which the free end comprises a surface, preferably a planar surface, forming the hammer per se and able to be pressed against the corresponding zero-reset cam 3.1, 3.2, 3.3. These cams 3.1, 3.2, 3.3 are usually heart-shaped, preferably in the shape of an asymmetric heart, so as to obtain an improved performance of the hammer-heart assembly, and are mounted on the axis of rotation of the corresponding indication element, which is often a hand or a disc, or are mounted on the axis of a wheel kinematically connected directly or indirectly to the axis of rotation of this element. For example, the indication element may be second, minute and hour hands of a chronograph mechanism or of a corresponding fly-back hand mechanism, such that the three hammers 4.1, 4.2, 4.3, or the three hearts 3.1, 3.2, 3.3 illustrated in the figures correspond to the hammers or to the hearts of the hours, minutes and seconds. The first control means 1 is movable in translation and the second control means 2 is movable in rotation about a pivot 2.1, a control return spring (not illustrated in the figures) tending to apply the end 2.2 of the second control means 2 against one of the hammers, preferably against the first hammer 4.1, as illustrated in FIGS. 1*a* and 1*b*. Normally, the first control means 1 is realized by a push-button to which the user of the timepiece can apply a manual force in order to cause, by means of said kinematic connection between the first control means 1 and second control means 2, a pivoting of this second control means 2. A winding stop 6.8, visible for example in FIGS. 1*b* and 3*b*, limits the course of the second control means 2 in the direction moving away from the hammers 4.1, 4.2, 4.3, following the application of a manual force on the first control means 1 by the user. The first control means 1 thus allows, by means of the second control means 2, to control a corresponding function, for example the zero-reset of the hands of a chronograph mechanism or a fly-back hand mechanism.

Contrary to the devices of the prior art, the device comprises at least two hammer springs 5.1, 5.2, 5.3, each of which is able to exert a press-tension force causing one of the zero-reset hammers 4.1, 4.2, 4.3 to pivot in the direction of the corresponding zero-reset cam 3.1, 3.2, 3.3, and a winding and release means or mechanism 6 as well as a locking means or mechanism 7. In the first embodiment of the device illustrated in FIGS. 1*a* to 1*c*, the hammer springs are formed by flat springs of which one end is mounted rigidly on the corresponding hammer and of which the other end is free so as to be able to receive a winding force by means of the winding and release means 6, as will be become clearer from the following description. As can be clearly seen, the springs could be mounted on said winding and release means 6 and the free ends of said springs could cooperate with the hammers 4.1, 4.2, 4.3, this design not being illustrated in the figures.

In fact, said winding and release means 6 is able to wind said hammer springs 5.1, 5.2, 5.3 during a first phase of an actuation of the first control means 1 and also to cooperate, during a second phase of the actuation of the first control means 1, with said locking means 7, such that said locking means 7 passes from a first, rest position, in which the locking means 7 holds the zero-reset hammers 4.1, 4.2, 4.3 in the rest positions thereof, into a second, release position. In this second position, the locking means 7 frees the zero-reset hammers 4.1, 4.2, 4.3 which then come, in each case under the action of the corresponding hammer spring 5.1, 5.2, 5.3, into the position of cooperation thereof with the corresponding zero-reset cam 3.1, 3.2, 3.3, as will be described in greater detail in the following description.

FIGS. 1*a* and 1*b* clearly show, in the first embodiment of the device according to the invention, that the winding and release means 6 is formed by a bar kinematically connected to the second control means 2 and comprising at least two, in the example illustrated in the figures, three winding elements 6.1, 6.2, 6.3, each of which is able to bear against the free end of the corresponding hammer spring 5.1, 5.2, 5.3, so as to be able to wind, during said first phase of the actuation of the first control means 1, said hammer spring 5.1, 5.2, 5.3. The winding elements can be formed preferably by winding pins 6.1, 6.2, 6.3 mounted at a suitable distance along the bar 6.

The winding and release means 6 also comprises a release part 6.4 able to cooperate with the locking means 7, such that said locking means passes, during said second phase of actuation of the first control means 1, from the first, rest position thereof, in which the locking means 7 holds the zero-reset hammers 4.1, 4.2, 4.3 in the rest positions thereof, into the second, release position thereof, in which the locking means 7 releases the zero-reset hammers 4.1, 4.2, 4.3. This release part is preferably formed by an inclined plane or a rounded edge 6.4 arranged close to the end thereof oriented toward said locking means 7 and able to come into contact with said locking means 7.

Similarly to the second control means 2, which is normally articulated at one of the ends thereof to the first control means 1, the kinematic connection between the winding and release means 6 and the second control means 2 can be produced for example by a pivot pin 6.7 articulated to the other end 2.2 of the second control means 2. Also having a longitudinal groove 6.5 in its end opposite the second control means 2, in which groove a guide shaft 6.6 mounted on a bridge of the corresponding timepiece and visible by way of example in FIG. 3*b* is fitted, said winding and release means 6 is then displaceable in rotation about said guide shaft 6.6, following an actuation of the first control means 1. The rotational movement preferably has a large radius.

With regard to said locking means 7, this is preferably formed by a locking lever mounted pivotably about a pivot 7.1 and prestressed by a return locking spring, in the direction of one of the zero-reset hammers 4.1, 4.2, 4.3, against a locking stop 7.3 which defines the rest position of said locking means. The locking means is preferably prestressed in the direction of the first zero-reset hammer 4.1, which is arranged closest to the second control means 2, however it is possible for the locking means to be prestressed in the direction of one of the other hammers 4.2, 4.3. The hammer against which the locking lever 7 is prestressed, therefore usually the first zero-reset hammer 4.1 as is also illustrated in the figures, comprises a notch 4.1.4, with/from which a locking part 7.2 of the locking lever 7 can be engaged or disengaged. In addition, at least this hammer preferably also comprises a guide part 4.1.5, which may be slightly rounded, allowing to guide the locking part 7.2 during the movement thereof following a disengagement, then subsequently in the return movement thereof toward the notch 4.1.4. The locking part can be realized by a locking pin 7.2 mounted on the lever 7 or by a one-piece part of suitable shape for engagement with said notch 4.1.4 in one of the zero-reset hammers 4.1, 4.2, 4.3.

It can also be seen from FIGS. 1*a* to 1*c* that the zero-reset device according to the present invention comprises a return means 8 of the zero-reset hammers 4.1, 4.2, 4.3, said return means being able to return the zero-reset hammers 4.1, 4.2, 4.3 into the rest position thereof, following actuation thereof. In the first embodiment illustrated schematically in FIGS. 1*a* to 1*c*, said return means 8 is formed by a return bar connected kinematically to each of the zero-rest hammers 4.1, 4.2, 4.3. In order to ensure that each hammer 4.1, 4.2, 4.3 can strike independently against the corresponding heart 3.1, 3.2, 3.3, said connection between the return bar 8 and the hammers is produced virtually without play with the one of the zero-reset hammers 4.1 cooperating with the locking means 7, therefore in the embodiment illustrated in the figures with the first hammer 4.1, and with play for the other zero-reset hammers 4.2, 4.3. This can be implemented by placing a first pivot 8.1 virtually without play between the first hammer 4.1 and the return bar 8, whereas the second pivot 8.2 and third pivot 8.3 mounted on the second hammer 4.2 and the third hammer 4.3 respectively are fitted with play in corresponding openings in the return bar, the respective size of these openings being greater than the diameter of the pivots 8.2, 8.3, as visible in FIG. 1*b*. This play is preferably approximately from 0.10 mm to 0.35 mm, said openings additionally being arranged such that the edges thereof do not touch the second pivot 8.2 and third pivot 8.3 when the hammers bear against the respective heart. A return stop 8.4 defines the rest position of the return bar 8, respectively of the zero-reset hammers 4.1, 4.2, 4.3, by being placed such that one of the hammers, in the illustrated example the third hammer 4.3, bears against said return stop 8.4 once the user no longer applies manual force to the first control means 1. In fact, in this case, said control return spring of the second control means 2 returns said second control means as well as the zero-reset hammers 4.1, 4.2, 4.3 into the respective rest positions thereof by means of the return means 8.

The above explanations concerning the structure and the components of a zero-reset device according to the present invention also allow to easily understand the functioning of said device, in particular with the aid of FIGS. 2*a* to 2*e*. In fact, in the rest position illustrated in FIG. 1*b*, the hammer springs 5.1, 5.2, 5.3 are not wound and the winding means 7 is in the rest position thereof, bearing against the locking stop 7.3. Similarly, the control return spring forces the end 2.2 of the second control means 2 to bear against the first hammer 4.1, in the example illustrated in the figures. This first hammer 4.1 pushes the return bar 8 in the direction of the second hammer 4.2 and third hammer 4.3, such that the return bar holds the hammers 4.1, 4.2, 4.3 in a position distanced from the hearts, the return stop 8.4 limiting the distancing of the hammers 4.1, 4.2, 4.2 from the corresponding hearts 3.1, 3.2, 3.3. In this rest position, a small play in rotation that have the second hammer 4.2 and third hammer 4.3 will also be noted, given that the second pivot 8.2 and third pivot 8.3 mounted on these hammers are free in the respective fit thereof on the return bar 8, whereas the first hammer 4.1 has no play. In other words, in the rest position, all the hammers 4.1, 4.2, 4.3 are distanced from the hearts 3.1, 3.2, 3.3 and are held in this position, by means of the return bar 8, by the control return spring.

Figure 2A:
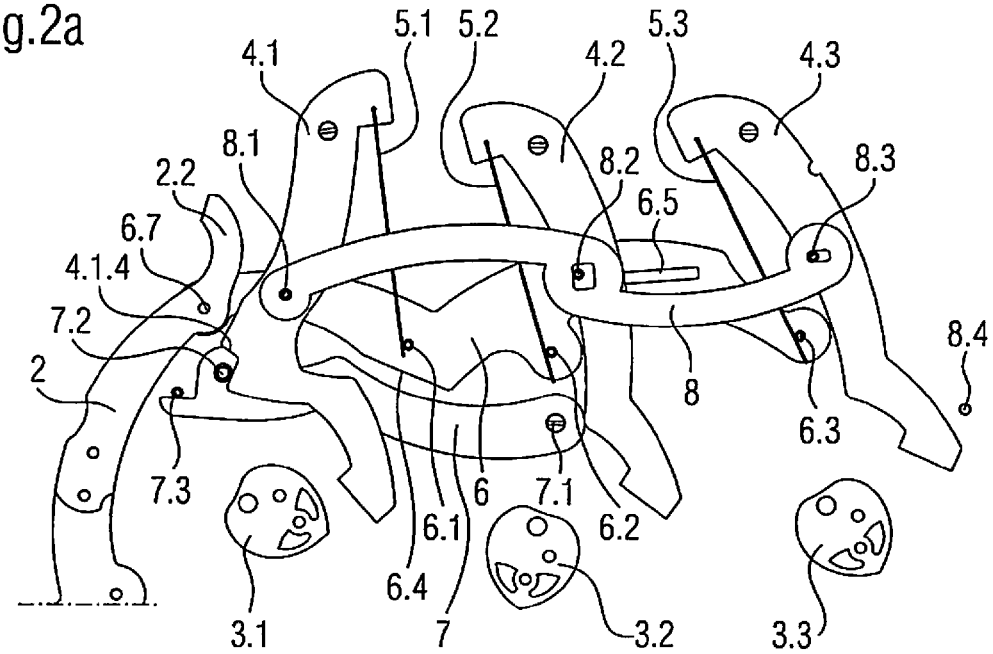
FIG. 2*a* shows a plan view of the zero-reset device according to FIGS. 1*a* to 1*c* in the position thereof just after the start of the first phase of actuation of the first control means.

FIG. 2*a* shows a plan view of the zero-reset device according to FIGS. 1*a* to 1*c* in the position thereof just after the start of the first phase of actuation of the first control means 1 following the application of a manual force by the user of the corresponding timepiece, and thus shows the step in which the device has just left the rest position. By pressing on the push-button 1, the user causes the second control means 2 and also the winding and release means 6 to pivot. This winding and release means 6, in this phase of actuation, is used to wind the hammer springs 5.1, 5.2, 5.3 by means of winding pins 6.1, 6.2, 6.3 carried by said winding and release means. By comparing FIGS. 1*b* and 2*a*, it is noted that there is first a small amount of play, which is preferably approximately from 0.10 mm to 0.40 mm, to be made up for before the winding of the springs starts, that is to say before each of the winding pins 6.1, 6.2, 6.3 touches the free end of the corresponding hammer spring 5.1, 5.2, 5.3. In this position, there is no longer any contact between the free end 2.2 of the second control means 2 and the first hammer 4.1. Similarly, it is noted that the locking pin 7.2 only comes into contact with the first zero-reset hammer 4.1, at the notch 4.1.4 thereof, in the position illustrated in FIG. 2*a*, whereas this contact is not yet established in the rest position illustrated in FIG. 1*b*.

Figure 2B:
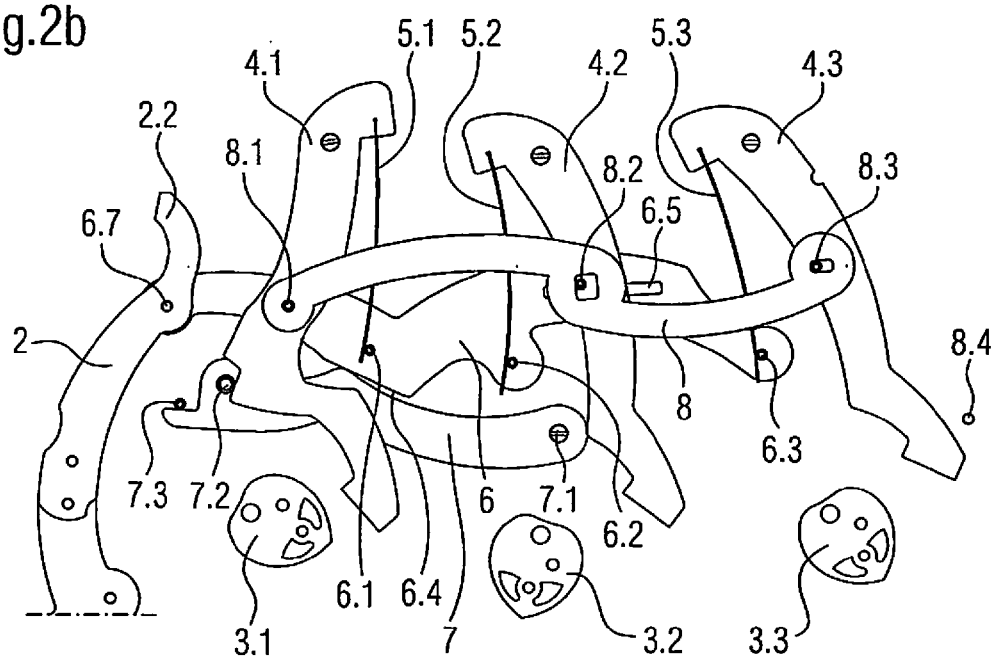
FIG. 2*b* is a plan view of the device in the position thereof during the first phase of said actuation at the moment at which the winding and release means establishes contact with the locking means.

FIG. 2*b* is a plan view of the device in the position thereof during the first phase of said actuation at the moment at which, when the pressure on the push-button 1 by the user continues, the winding and release means 6 comes into contact with the locking means 7, therefore at the moment at which the winding and release means 6 is no longer used only to wind the hammer springs 5.1, 5.2, 5.3, but at which it also performs a release function. In fact, during this phase, the first hammer 4.1 is stressed increasingly by the spring 5.1 thereof, which is in turn wound increasingly by the winding pin 6.1, whilst remaining limited in rotation by the locking pin 7.2 mounted on the locking means 7. The springs 5.2, 5.3 of the second hammer 4.2 and third hammer 4.3 wind themselves simultaneously, given that these hammers 4.2, 4.3 cannot strike against the respective heart 3.2, 3.3 thereof, either, because the return bar 8, blocked by means of the first hammer 4.1, holds them at a distance. On the other hand, contact is created between the release part 6.4, that is to say the inclined plane or the rounded edge 6.4, of the winding and release means 6 and the locking means 7, which gradually causes a pivoting of the locking means 7. The locking pin 7.2 mounted on said locking means thus slides along the notch 4.1.4 in the hammer 4.1, before disengaging therefrom.

Figure 2C:
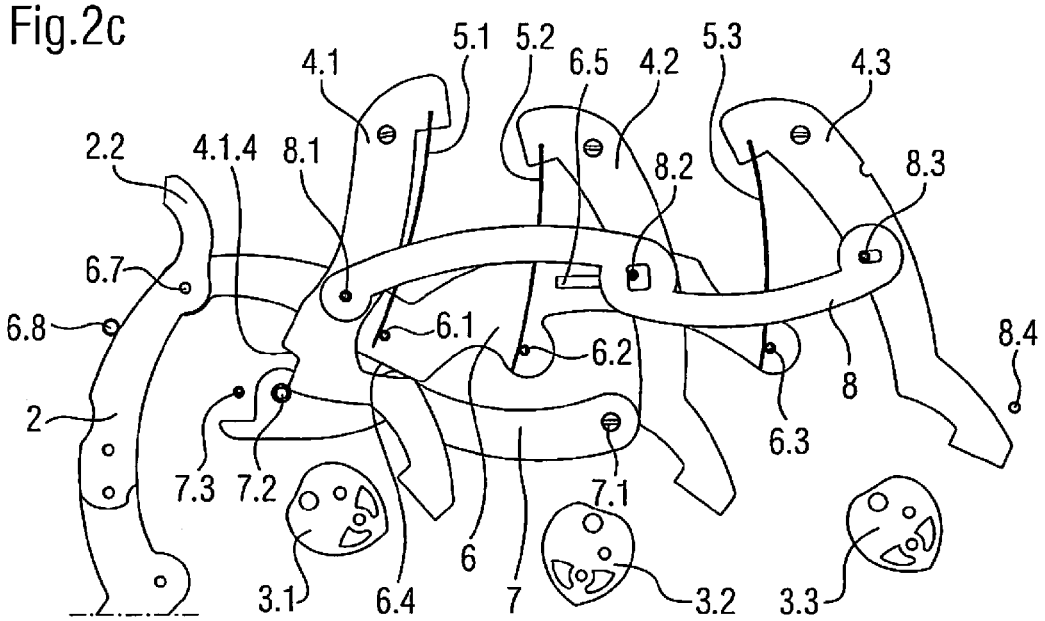
FIG. 2*c* is a plan view of the device in the position thereof at the end of the first phase of said actuation just before the moment at which the winding and release means causes the release of the zero-reset hammers.

FIG. 2*c* is a plan view of the device in the position thereof at the end of the first phase of said actuation just before the moment at which the winding and release means 6 causes, by means of the locking means 7, the release of the zero-reset hammer with which it cooperates. In particular, FIG. 2*c* shows the position corresponding to the maximum winding of the hammer springs 5.1, 5.2, 5.3 and just before the release of the hammers 4.1, 4.2, 4.3, that is to say before the moment at which the locking pin 7.2 mounted on the locking means 7 disengages from the notch 4.1.4 of the first hammer 4.1. The moment of release corresponds to the moment at which the locking pin 7.2 can no longer retain the first hammer 4.1 and then slides along said guide part 4.1.5 of the first hammer 4.1, no longer opposing the displacement of this hammer 4.1, aside from a negligible friction created by the action of the return spring of the locking means 7, which applies the locking pin 7.2 against this guide part 4.1.5 of the first hammer 4.1.

Figure 2D:
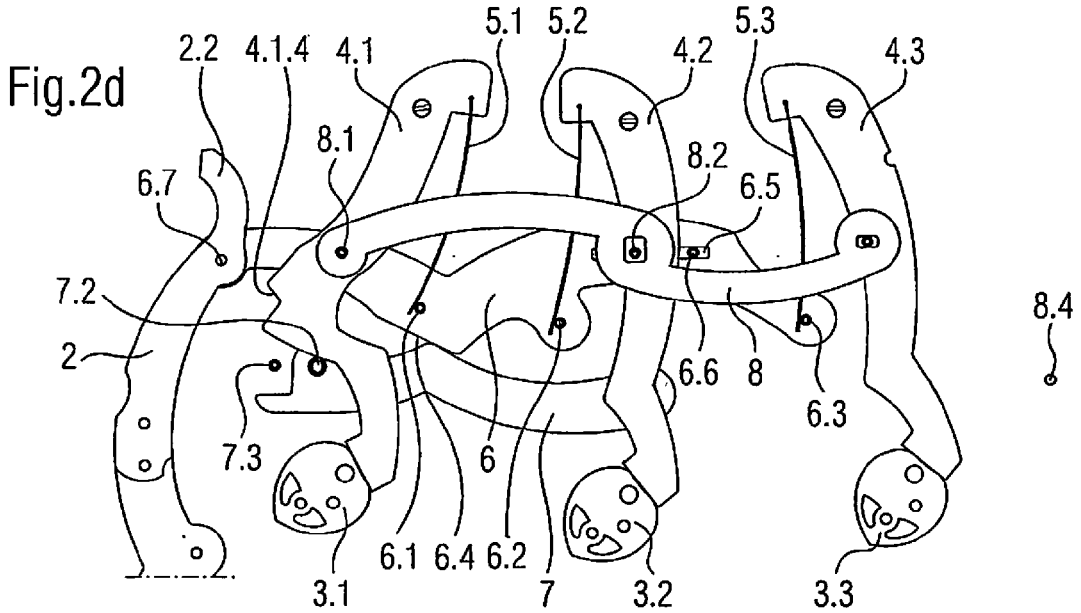
FIG. 2*d* is a plan view of the device in the position thereof during the second phase of said actuation once the zero-reset hammers have struck against the corresponding zero-reset cams.

FIG. 2*d* is a plan view of the device in the position thereof during the second phase of said actuation, when the pressure on the push-button 1 by the user continues, once the zero-reset hammers 4.1, 4.2, 4.3 have struck against the corresponding zero-reset cams 3.1, 3.2, 3.3. In fact, the first hammer 4.1 being freed at the end of the phase of actuation illustrated in FIG. 2*c*, the return bar 8 can also be displaced, due to the fact that it is connected to the first hammer 4.1. Since the return bar was the only part that retained the second hammer 4.2 and third hammer 4.3, these two hammers are also freed. At the moment of the release, the hammers 5.1, 5.2, 5.3 thus strike against the cams or hearts 3.1, 3.2, 3.3 with a well defined zero-reset force, which corresponds to the maximum winding force of the hammer springs 5.1, 5.2, 5.3 reached in the position illustrated in FIG. 2*c*. The hammer springs 5.1, 5.2, 5.3 have been wound by the force of the user. The energy accumulated at this stage is sufficient to perform the zero reset. The springs 5.1, 5.2, 5.3 nevertheless maintain a residual winding, that is to say the springs 5.1, 5.2, 5.3 are still partially wound once the hammers 4.1, 4.2, 4.3 bear against the heart 3.1, 0.3.2, 3.3. In fact, once applied against the hearts, the hammers 5.1, 5.2, 5.3 apply a maintenance force to these hearts 3.1, 3.2, 3.3, which corresponds to the residual winding force of the hammer springs 5.1, 5.2, 5.3 in the position illustrated in FIG. 2*d*. Then, by continuing to press the button, the user continues to wind the springs 5.1, 5.2, 5.3, in spite of the fact that the hammers 4.1, 4.2, 4.3 already bear against the hearts 3.1, 3.2, 3.3 thereof, so as to maintain the pressure on the hearts. To avoid any damage, the course of the push-button 1, of the second control means 2 and also of the winding and release means 6, and therefore the force of pressure on the hearts 3.1, 3.2, 3.3, is nevertheless limited by the winding stop 6.8, against which the free end 2.2 bears when the user has finished pressing on the push-button 1. It should be noted with regard to the position illustrated in FIG. 2*d* that the movement of the zero-reset hammers 4.1, 4.2, 4.3 toward the zero-reset cams 3.1, 3.2, 3.3 as well as the bearing thereof against the corresponding heart are performed independently and are not hampered by the control bar 8, in particular at the level of the second hammer 4.2 and third hammer 4.3, given the play of the second pivot 8.2 and third pivot 8.3 in the corresponding opening thereof in said return bar 8.

Figure 2E:
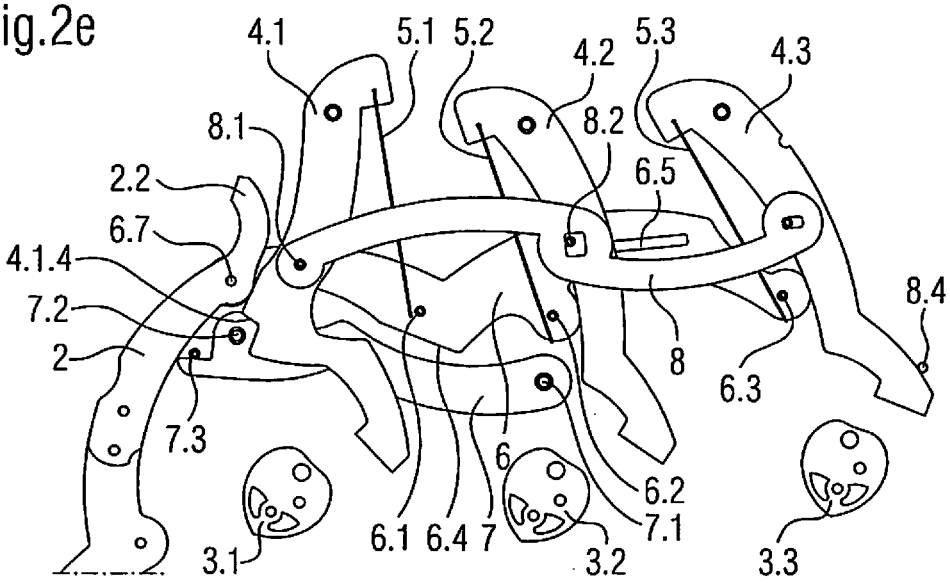
FIG. 2*e* is a plan view of the device in the position thereof once the first control means has been released by the user, such that the zero-reset hammers as well as the locking means have returned to the rest positions thereof.

FIG. 2*e* is a plan view of the device in the position thereof once the first control means has been released by the user, such that the zero-reset hammers 4.1, 4.2, 4.3 and also the locking means 7 have returned to the rest positions thereof. In fact, when the user releases the push-button 1, the control return spring pushes the second control means 2 and also the winding and release means 6 into the rest position illustrated in FIG. 1*b*. In this return phase, the free end 2.2 of the second control means 2 comes to rest against the first hammer 4.1. Beginning with this moment, the three hammers 4.1, 4.2, 4.3 are distanced from the hearts 3.1, 3.2, 3.3 by means of the second control means 2, respectively the return bar 8. Whilst the winding and release means 6 as well as the hammers 4.1, 4.2, 4.3 return into the rest positions thereof, the hammer springs 5.1, 5.2, 5.3 are disarmed. Simultaneously, the locking pin 7.2 slides over the guide part 4.1.5 of the first hammer 4.1 until it engages with the notch 4.1.4 in the first hammer 4.1, due to the action of the locking return spring, which presses the locking means 7 against the locking stop 7.3. Consequently, the device is again in the rest position thereof and is ready for use again.

Figure 3A:
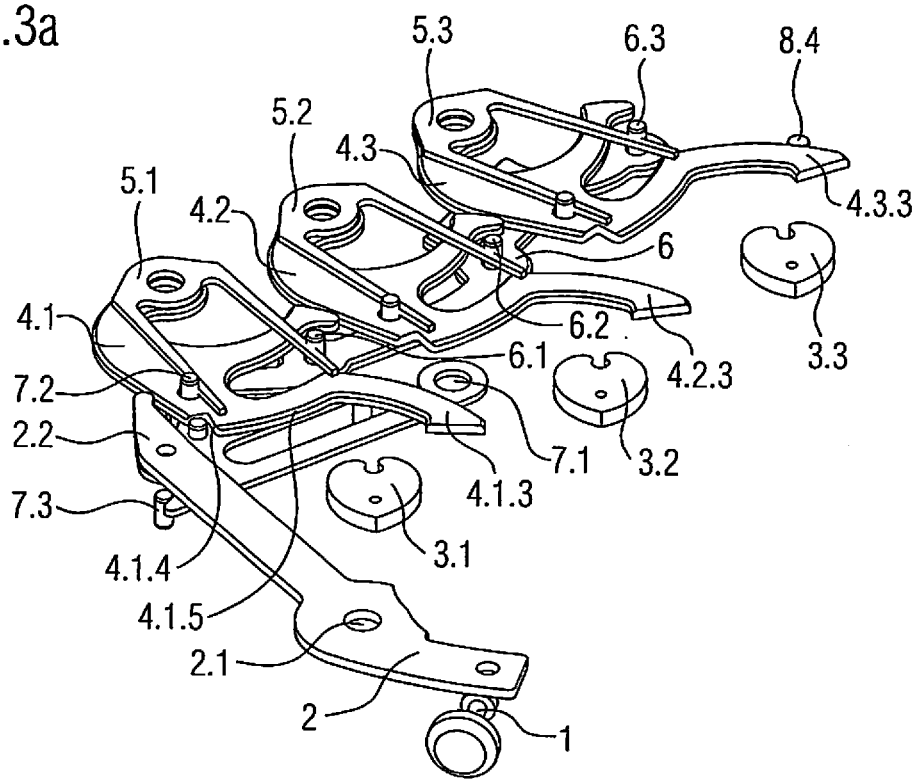
FIG. 3*a* shows a schematic perspective view of a second embodiment of the zero-reset device according to the invention.
Figure 3B:
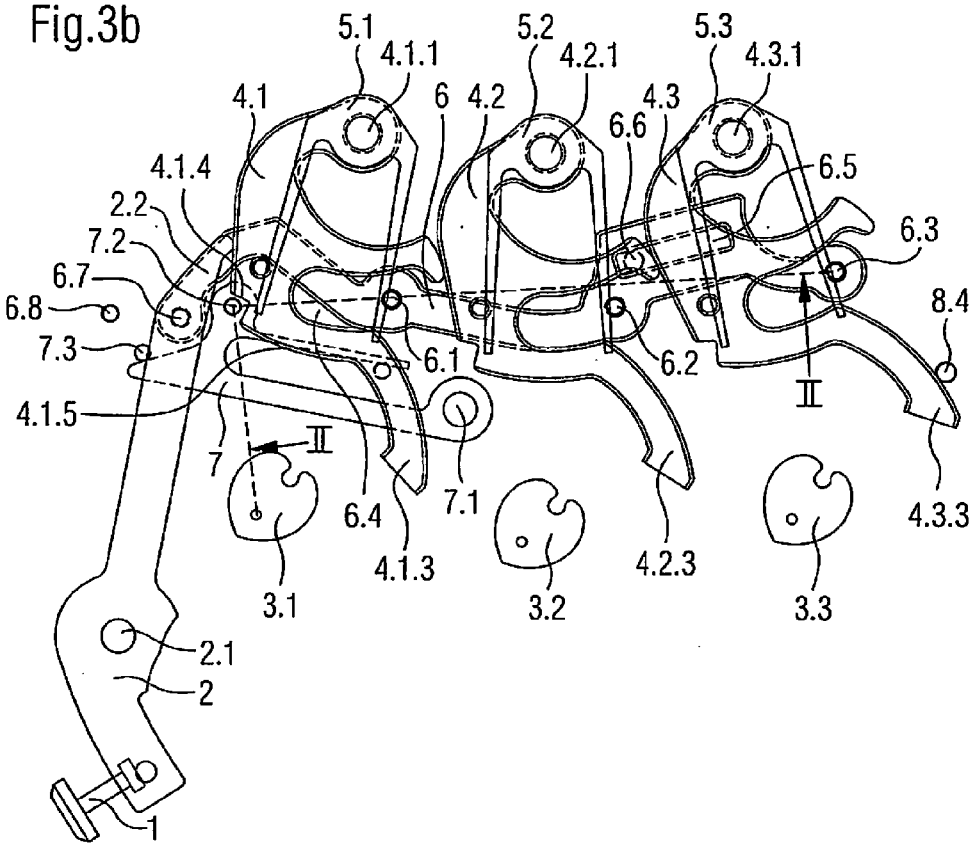
FIGS. 3*b* and 3*c* show, respectively, a plan view and a longitudinal section of this device along the line I-I indicated in FIG. 3*b*.
Figure 3C:
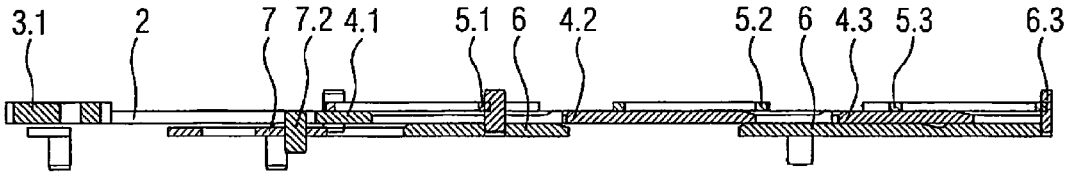
Figure 4A:
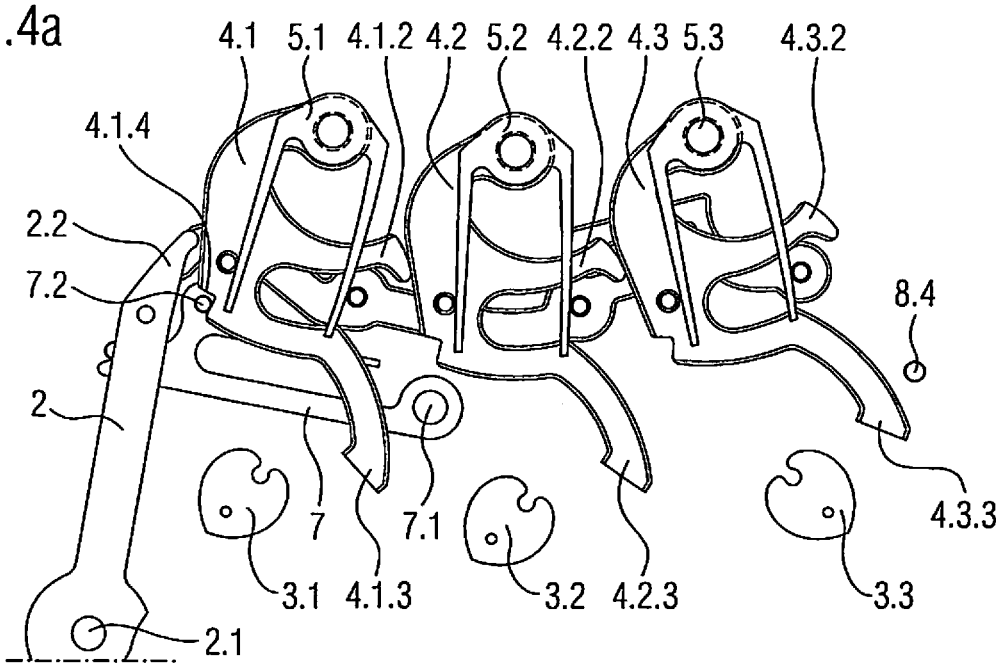
FIG. 4*a* shows a plan view of the zero-reset device according to FIGS. 3*a* to 3*c* in the position thereof just after the start of the first phase of actuation of the first control means.
Figure 4B:
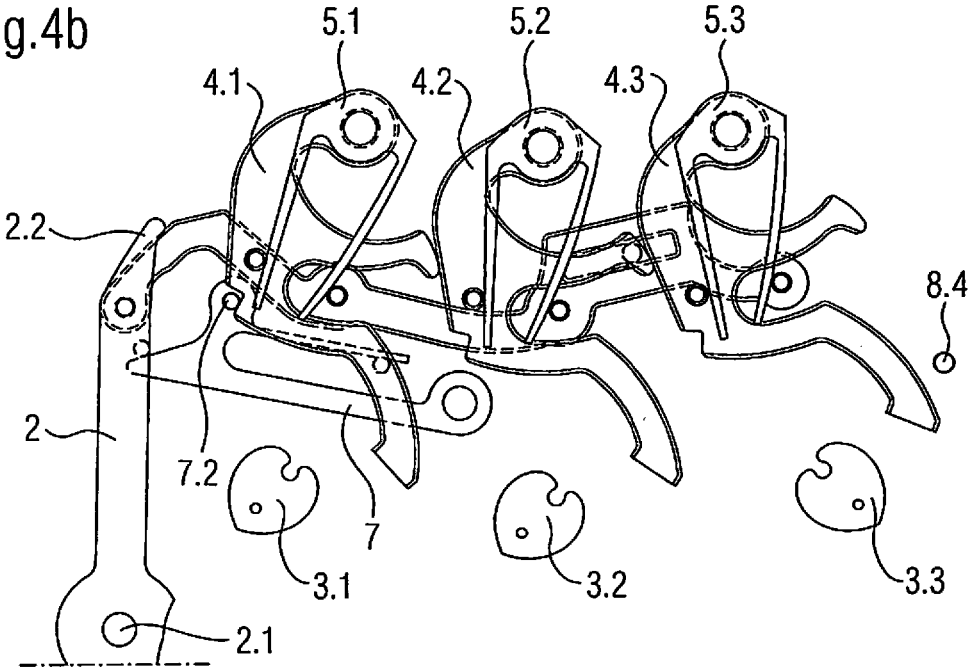
FIG. 4*b* is a plan view of the device in the position thereof during the first phase of said actuation at the moment at which the winding and release means establishes contact with the locking means.
Figure 4C:
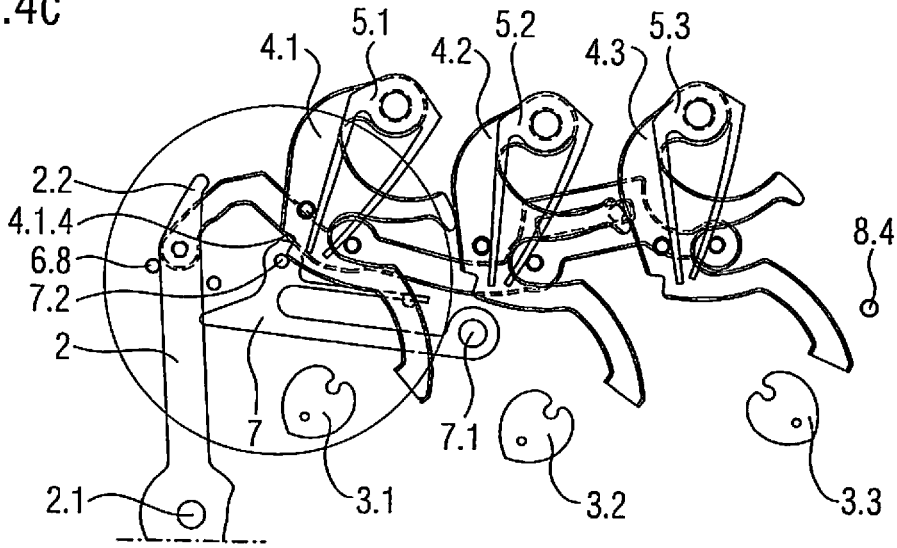
FIG. 4*c* is a plan view of the device in the position thereof at the end of the first phase of said actuation just before the moment at which the winding and release means causes the release of the zero-reset hammers.
Figure 4D:
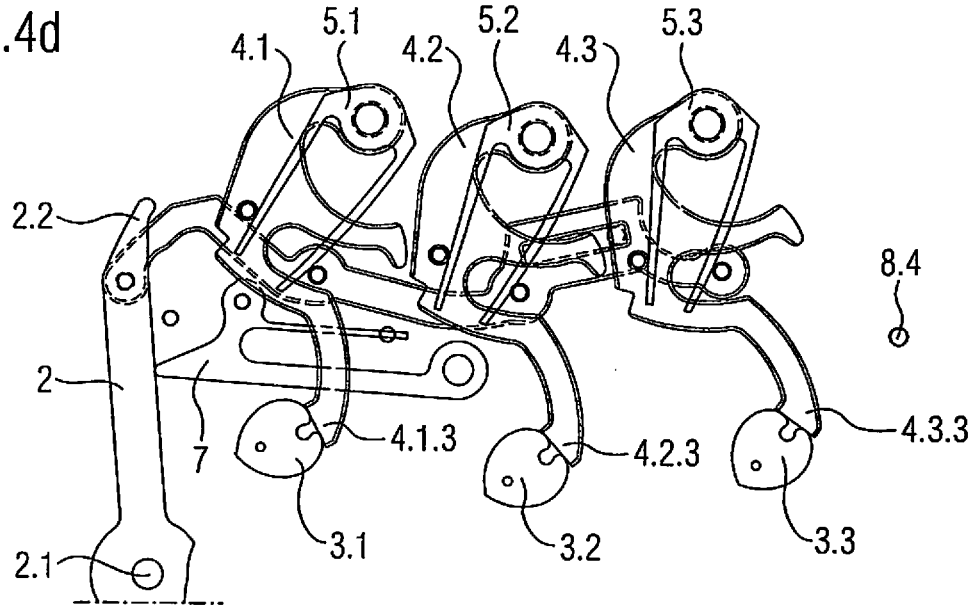
FIG. 4*d* is a plan view of the device in the position thereof during the second phase of said actuation once the zero-reset hammers have struck against the corresponding zero-reset cams.
Figure 4E:
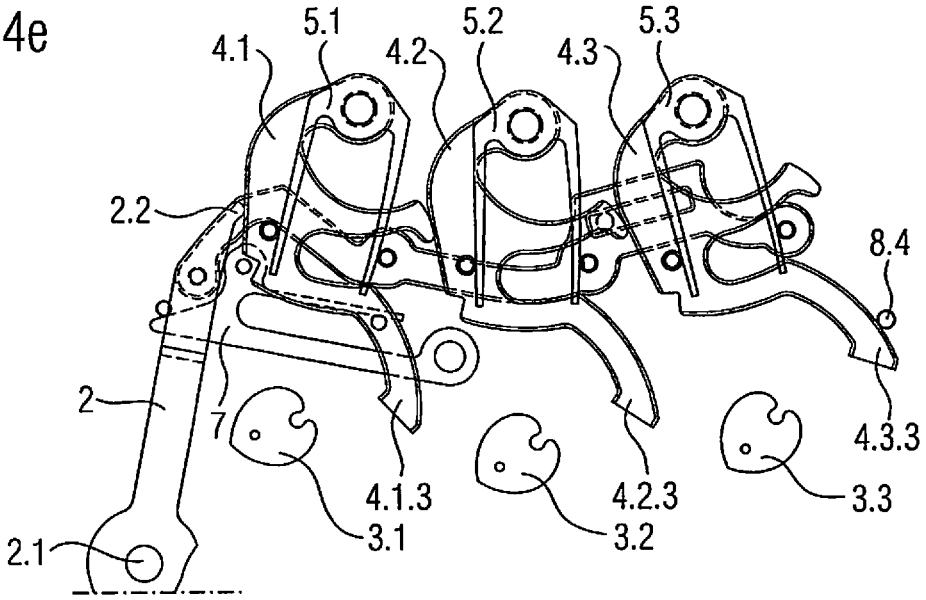
FIG. 4*e* is a plan view of the device in the position thereof once the first control means has been released by the user, such that the zero-reset hammers as well as the locking means have returned to the rest positions thereof.

A second embodiment of the zero-reset device according to the present invention is illustrated schematically and by way of example in FIGS. 3*a* to 3*c*. If the other elements of this device, aside from having a different shape or positioning without this resulting in a substantial difference, are identical to the device according to the first embodiment, the return means 8 is formed in the second embodiment of the device by a supplementary arm 4.1.2, 4.2.2, 4.3.2 arranged on at least one of the zero-reset hammers 4.1, 4.2, 4.3. These supplementary arms 4.1.2, 4.2.2, 4.3.2 thus replace the return bar 8 provided in the first embodiment and ensure a further improved independence between the zero-reset hammers 4.1, 4.2, 4.3, given that there is no longer any direct kinematic connection in this case, even at the level of a negligible friction as in the first embodiment between the hammers 4.1, 4.3, 4.3 during the phase of operation of the device during which said hammers move toward or are applied against the cams 3.1, 3.2, 3.3.

In addition, FIGS. 3*a* to 3*c* also emphasize that the device according to this second embodiment may advantageously be equipped with zero-reset hammers 4.1, 4.2, 4.3 which all have the same geometry, such that they have an identical weight and moment of inertia. This allows to further improve the accuracy of the moment at which the hammers strike against the respective heart thereof, given that, aside from manufacturing tolerances, said hammers in this figure should all demonstrate the same behavior.

It is also noted in FIGS. 3*a* to 3*c* that the hammer springs 5.1, 5.2, 5.3 of the second embodiment of the device are preferably formed by flat springs having two resilient arms, of which the first arm serves to receive a winding force by means of the winding and release means 6, similarly to the free end of the flat springs of the first embodiment of the device, and of which the second arm serves to transmit the winding force, once the springs have been wound, to the corresponding zero-reset hammer 4.1, 4.2, 4.3. The base of these hammer springs 5.1, 5.2, 5.3, arranged between the two resilient arms, is mounted on the zero-reset hammers 4.1, 4.2, 4.3, preferably concentrically with respect to the corresponding pivot pin 4.1.1, 4.2.1, 4.3.1.

The functioning of the zero-reset device according to the second embodiment is entirely similar to that which has been explained with reference to FIGS. 2*a* to 2*e* illustrating the functioning of the zero-reset device according to the first embodiment, aside from the fact that it is the supplementary arms 4.1.2, 4.2.2, 4.3.2 of the zero-reset hammers 4.1, 4.2, 4.3 instead of the return bar 8 provided in the first embodiment that maintain the distance between these three hammers and ensure a further improved independence between the zero-reset hammers 4.1, 4.2, 4.3 during the phase of striking thereof against the corresponding heart 3.1, 3.2, 3.3. FIGS. 4*a* to 4*e* correspond to FIGS. 2*a* to 2*e* and show in FIG. 4*a* a plan view of the second embodiment of the device in the position thereof just after the start of the first phase of the actuation of the first control means 1, in FIG. 4*b* a plan view of this device in the position thereof during the first phase of said actuation at the moment at which the winding and release means 6 comes into contact with the locking means 7, in FIG. 4*c* a plan view of the device in the position thereof at the end of the first phase of said actuation just before the moment at which the winding and release means 6 causes the release of the zero-reset hammers by pushing the locking means 7 such that said locking means frees the zero-reset hammer 4.1 with which it cooperates, in FIG. 4*d* a plan view of the device in the position thereof during the second phase of said actuation once the zero-reset hammers 4.1, 4.2, 4.3 have struck against the corresponding zero-reset cams 3.1, 3.2, 3.3, and, in FIG. 4*e*, a plan view of the device in the position thereof once the first control means 1 has been released by the user, such that the zero-reset hammers 4.1, 4.2, 4.3 as well as the locking means 7 have returned to the rest positions thereof, such that the device is again ready for use thereof.

Given the arrangement and functioning of the device described above, it is understood that the zero reset is performed only if the manual force applied by the user of the timepiece to the first control means 1 exceeds a predefined threshold value, which corresponds normally to the sum of the winding forces of the hammer springs 5.1, 5.2, 5.3 and of the control return spring. In addition, the zero-reset force applied by the hammers to the cams is always identical and corresponds to a predefined value, that is to say the maximum winding force mentioned above of the hammer springs 5.1, 5.2, 5.3, these factors allowing to ensure increased reliability of the functioning of the device. These advantages are obtained whilst ensuring maximum independence of the hammers, which have no direct kinematic connection therebetween, at least not during the application thereof against the cams, which improves the accuracy of the simultaneous actuation of the hammers. The second embodiment is particularly advantageous in this respect, given that it does not provide any direct kinematic connection that could be produced between the hammers during the striking phase thereof. In addition, an identical geometry of all the hammers as provided also in the second embodiment of the device only reinforces these advantages. In addition, the construction is robust and also as compact as possible as well as simple and reliable during use. The zero-reset device according to the present invention can be integrated in any type of timepiece, preferably in mechanical wristwatches, in particular in chronograph watches or watches having a fly-back hand. It is also possible, however, to use the device in electronic watches.

The invention claimed is:

1. A zero-reset device for a timepiece, in particular for a chronograph watch, the device comprising:

a first control mechanism;

a second control mechanism connected kinematically to said first control mechanism;

at least two zero-reset cams;

at least two corresponding zero-reset hammers being pivoted independently of one another and adapted to be actuated so as to cooperate with a corresponding zero-reset cam;

at least two hammer springs, each of which is adapted to exert a pre-tension force causing a zero-reset hammer to pivot in the direction of a corresponding zero-reset cam;

a winding and release mechanism; and a locking means mechanism;

wherein said winding and release mechanism is configured to wind said hammer springs during a first phase of an actuation of the first control mechanism as well as to cooperate, during a second phase of the actuation of the first control mechanism, with said locking mechanism, such that said locking mechanism passes from a first, rest position, in which the locking mechanism holds the zero-reset hammers in the rest positions thereof, to a second, release position, in which the locking mechanism releases the zero-reset hammers, which come, in each case, under the action of the corresponding hammer spring, into the positions thereof of cooperation with the corresponding zero-reset cam.

2. The device according to claim 1, wherein said winding and release mechanism is kinematically connected to the second control mechanism and is formed by a bar comprising at least two winding elements, each of the at least two winding elements being adapted to bear against a corresponding hammer spring, so as to be able to wind said hammer spring during said first phase of the actuation of the first control mechanism.

3. The device according to claim 2, wherein said winding elements are formed by pins.

4. The device according to claim 2, wherein said winding and release mechanism is displaceable, following an actuation of the first control mechanism, in rotation of a large radius about a guide shaft fitted in a longitudinal groove in said winding and release mechanism, said kinematic connection between the winding and release mechanism and the second control mechanism being formed by a pivot pin.

5. The device according to claim 1, wherein said winding and release mechanism comprises a release part adapted to cooperate with the locking mechanism, such that said locking mechanism passes, during said second phase of the actuation of the first control mechanism, from the first, rest position thereof, in which the locking mechanism holds the zero-reset hammers in the rest positions thereof, to the second, release position thereof, in which the locking mechanism releases the zero-reset hammers.

6. The device according to claim 5, wherein said release part is formed by an inclined plane or a rounded edge able to come into contact with said locking mechanism.

7. The device according to claim 1, wherein said locking mechanism is formed by a locking lever mounted pivotably and pre-tensioned against one of the zero-reset hammers, the latter comprising a notch with which a locking part of said locking mechanism can be engaged, or from which the locking part can be disengaged.

8. The device according to claim 7, wherein said locking part is formed by a pin or by a part having a shape adapted for engagement with said notch in one of the zero-reset hammers.

9. The device according to claim 1, wherein the device further comprises a return mechanism of the zero-reset hammers adapted to return the zero-reset hammers into the rest position thereof following actuation thereof.

10. The device according to claim 9, wherein said return mechanism of the zero-reset hammers is formed by a supplementary arm arranged on at least one of the zero-reset hammers.

11. The device according to claim 9, wherein said return mechanism of the zero-reset hammers is formed by a return bar connected kinematically to each of the zero-reset hammers, said connection being formed without play with the zero-reset hammer that cooperates with the locking mechanism and with play for the other zero-reset hammers.

12. The device according to claim 1, wherein said zero-reset hammers all have the same geometry.

13. The device according to claim 1, wherein said first control mechanism is movable in translation and said second control mechanism is movable in rotation.

14. The device according to claim 1, wherein aid first control mechanism is a push-button.

15. A timepiece, preferably a mechanical wristwatch, wherein the timepiece comprises a chronograph mechanism or a fly-back hand mechanism equipped with a zero-reset device according to claim 1.

* * * * *